US006760929B2

(12) United States Patent
Dippel

(10) Patent No.: US 6,760,929 B2
(45) Date of Patent: Jul. 13, 2004

(54) CANTILEVERED LIMITED MOBILITY BENCH TOILET AND COMMODE

(76) Inventor: David William Dippel, 336-15 th Ave., San Francisco, CA (US) 94118-2807

( * ) Notice: Subject to any disclaimer, the term of this patent is extended or adjusted under 35 U.S.C. 154(b) by 38 days.

(21) Appl. No.: 10/228,354

(22) Filed: Aug. 26, 2002

(65) Prior Publication Data

US 2004/0034912 A1 Feb. 26, 2004

(51) Int. Cl.[7] ..... A47K 11/04

(52) U.S. Cl. ..... 4/483; 4/480; 4/254; 4/479; 4/576.1; 4/571.1; 4/234

(58) Field of Search ..... 4/480, 254, 479, 4/483, 576.1, 571.1, 234

(56) References Cited

U.S. PATENT DOCUMENTS 4,028,749 A * 6/1977 James ..... 4/480
4,085,472 A 4/1978 DiMatteo
4,334,330 A 6/1982 Marshall
4,510,631 A 4/1985 Grady
4,553,274 A * 11/1985 Yui ..... 4/420.4
4,823,412 A 4/1989 Spiegel
4,837,868 A 6/1989 Allen
4,856,123 A * 8/1989 Henderson et al. ..... 4/480
5,123,126 A 6/1992 Vincent
5,224,754 A 7/1993 Jeanes
5,289,596 A 3/1994 Rose et al.
5,341,517 A 8/1994 Bly
5,384,920 A 1/1995 Havens
5,477,569 A 12/1995 Porter
5,526,537 A 6/1996 Conrad
5,687,431 A * 11/1997 Garrett ..... 4/254
5,947,562 A * 9/1999 Christofferson et al. ..... 297/440.22
6,009,570 A 1/2000 Hargest et al.
6,286,154 B1 9/2001 Pitts
6,567,997 B2 * 5/2003 Harper ..... 4/480

* cited by examiner

*Primary Examiner*—Henry Bennett
*Assistant Examiner*—Azy Kokabi

(57) ABSTRACT

A healthcare device intended for use by persons with either temporary or permanent limited mobility as a paraplegic or near paraplegic, who possess full use of the upper body and upper extremities. An intermediary device between the bedside commode where use of lower extremities permits walking, and the bedpan where a person is immobile or requires the help of an attendant or caregiver. This toilet or commode does not require the user to stand or sit independently, and there is no need to turn around for use. It is comprised of a wedged shaped, smooth surface, ventrally cantilevered bench with a toilet opening above a suspended waste collection bucket at the enlarged far end. Enclosed on three sides by a girdling fence rail, it is approached directly by a wheelchair user who, with chair brakes set, can slide forward onto the co-planer bench using the parallel side rails to aid in forward and backward movement. The user can adjust clothing as necessary in a forward sitting attitude at the end of the bench, using the end and side rails for positioning and stabilizing. The user need not stand and turn to use this toilet and commode, so the risk of falling is minimized.

3 Claims, 6 Drawing Sheets

CANTILEVERED LIMITED MOBILITY BENCH TOILET AND COMMODE

CROSS-REFERENCE TO RELATED APPLICATIONS

Not Applicable.

STATEMENT REGARDING FEDERALLY SPONSORED RESEARCH DEVELOPMENT

Not Applicable.

REFERENCE TO SEQUENCE LISTING, A TABLE, OR A COMPUTER PROGRAM LISTING COMPACT DISK APPENDIX

Not Applicable.

BACKGROUND OF THE INVENTION

This invention belongs to the class of hospital, sick room, or independent living equipment intended to allow people with limited or no ability to walk safely and independently to conduct an essential function of life-use a toilet without the risk of falling. This invention is drawn to the problem of falling while using toilets or commodes. This invention is a great improvement over the prior art.

This invention addresses three (3) of the chief problems encountered by designs of bedside commodes or the standard flush toilet used in ADA compliant lavatory water closets. First, the need to turn either 90° when getting out of bed prior to using a bedside commode. Second, the need for those using a walker or wheelchair to turn through up to 180° to use a bedside commode or standard flush toilet. This invention requires no turning to enable a person to use it. And third, the need to rise or sit independently which has required people to employ an attendant or helper.

This invention is uniquely different from the prior art.

U.S. Pat. No. 4,856,123 to Henderson et al (1989) is a cantilevered bed transfer and toilet device which enables a caregiver or attendant to roll or lift an immobile patient onto an over bed co-planer surface that folds into a chair position for use as a commode or over toilet transport when pulled away from the bed. This device utilizes a traditional bedside to gurney transfer approach and is admirably suited for bedridden, immobile patients, but can not, because of its side mounting approach, be used for wheelchairs because of their large rear wheels.

U.S. Pat. No. 6,567,997 to Harper (2003) is a mobility assisting device and commode for hemiplegics, that is for those who have full use of limbs on one side of the body. This device takes a standard configuration of a bedside commode and utilizes three (3) vertical pull-poles and a rotatable disk to utilized a therapeutic and rehabilitative stand and pivot maneuver to swing through a 90° turn to mount and dismount the commode seat. Although admirably suited for hemiplegics who can stand with the assistance of vertical pull-poles to make a pivoting turn, this device can not be used by paraplegics who can not stand and must support their full weight with upper body movements.

U.S. Pat. No. 6,286,154 to Pitts (2001) requires individuals with limited mobility to rise and turn 180° with the use of handrails, and lower her/himself onto a toilet seat. This design was not intended for persons who can not stand, let alone turn safely through 180°, and lack the ability to stand to lower themselves onto a toilet seat. This device is of limited use to those persons incapable of standing or walking.

Another U.S. Pat. No. 6,009,570 to Hargest, Blackwell, and Moss (2000) addresses the impact of lack of mobility on the use for either bedside commodes or standard water closets by incorporating a special commode into either a wheelchair or a bed. Although such a device is a boon to people who can not, or do not wish to or need to move around, it is overly complex and does not meet the needs of persons wishing or needing to move about.

Another U.S. Pat. No. 5,526,537 to Conrad (1996) addresses the specific lavatory needs of male orthopaedic patients with leg and/or hip trauma associated with surgical procedures. This device is also of general use for female medical patients with restricted leg/torso movement. However, more conventional bedside commodes are better suited to address the needs of people with average mobility. Although this device works well next to a bed for post-operative orthopaedic patients, it can not be used easily with wheelchairs or walkers.

Another U.S. Pat. No. 5,477,569 to Porter (1995) is merely a portable toilet for children which is, in design and use, subject to the same limitations as the various designs for bedside commodes. Firstly, the need to be able to stand and walk. Secondly, the need for a person to be able to turn through 90° or 180° to use the device. And thirdly, the need for a person to rise or sit independently or with assistance when using the device.

Another U.S. Pat. No. 5,384,920 to Havens (1995) addresses the issue of a bedridden patient having to turn 90° to use a bedside commode by incorporating a tapered board as part of a side rail of the commode. This tapered board rests on the patient's bed and allows the patient to slide sideways off the bed and onto the bedside commode. Besides being more appropriate for those individuals who have moderate use of the lower extremities, this device is unsuitable for wheelchair use because there is a wheel blocking any side to side movement. It is of no value for walkers.

Another U.S. Pat. No. 5,341,517 to Bly (1994) is a much improved portable commode which can be used at bedside or in various other circumstances. Again, this is a device which, whether used as a bedside commode or elsewhere, requires a fair degree of mobility and stability in the person using it. Again, when used at bedside, a person using it must turn through 90° and someone in a wheelchair or walker must be able to turn from 90° up to 180° depending on the angle of approach.

Another U.S. Pat. No. 5,289,596 to Rose and Hodge (1994) only varies in method of construction and material from other portable commodes: it is made with unitary molded plastic. Again, in order to use it a person must be able to stand and turn at least 90°.

Another U.S. Pat. No. 5,224,754 to Jeanes (1993) addresses the inherent difficulties of mobility and the angle of approach by employing what amounts to an electrically controlled compact bedpan on the end of a swinging arm. Although novel in approach, this device can not be adapted as part of a traditionally plumbed ADA compliant water closet, and can not be cheaply produced for the numbers cited in the specification.

Another U.S. Pat. No. 5,123,126 to Vincent (1992) is essentially a bedpan on a bracket intended primarily for the frail elderly. Although it allows a user to approach and use it without turning, this device has several drawbacks. First, it requires a fair degree of mobility. Second, it is not adapted for wheelchair use. Third, it can not be adapted as part of a traditionally plumbed ADA compliant water closet. And last, it suffers from the same lightweight construction that makes traditional bedside commodes unstable and subject to being tipped over.

Another U.S. Pat. No. 4,823,412 to Spiegel (1989) is a traditional commode chair with an improved supporting structure or undercarriage. Despite its improved bracing and support, this device continues the practice of requiring users to be somewhat mobile, able to sit and rise unassisted, and be capable of turning through at least 90°.

Another U.S. Pat. No. 4,837,868 to Allen (1989) is the usual portable commode with one exception: a sidewall that opens to allow an attendant to clean the patient. Again, in addition to requiring an attendant, this commode is limited by the same questions of mobility, turning, sitting and standing.

Another U.S. Pat. No. 4,510,631 to Grady (1985) is a device to seamlessly move a patient from the bedside to the commode, but lacks the versatility to be used for both bedside use and other applications. This device has a restricted area of use and can not be used with wheelchairs, walkers, or adapted as part of a traditionally plumbed ADA compliant water closet.

Another U.S. Pat. No. 4,334,330 to Marshall (1982) employs a moveable side ramp to enable a patient to move laterally from a bed to the commode. This device lacks the versatility to be used for both bedside use and other applications. This device has a restricted area of use and can not be used with wheelchairs, walkers, or adapted as part of a traditionally plumbed ADA compliant water closet.

Further U.S. Pat. No. 4,085,472 to DiMatteo (1978) employs a bedpan embedded in a mattress to avoid the issue of mobility. This device is of no use to anyone using a wheelchair or walker, and is limited to a sick room.

BRIEF SUMMARY OF THE INVENTION

The object of this invention is to eliminate one of the greatest dangers for people with limited or impaired ability to walk: the risk of falling in the home or in public lavatories. Additionally, there is the secondary need to restore and maintain a sense of self-sufficiency to people who, because of mobility and balance problems, must otherwise rely upon an attendant or helper to safely utilize a toilet or commode.

This invention is essentially a toilet or commode which does not require the user to stand or sit independently, and there is no need to turn around in order to use it. By eliminating the need to be able to stand to turn this invention minimizes the risk of falling. Additionally, this toilet and commode is not limited solely to bedside use, wheelchairs, walkers, or modification as a traditionally plumbed rear spud ADA compliant toilet.

With parallel, laddered hand rails on either side of a wheelchair height bench, any person with moderate upper body strength can approach this device directly from a wheelchair. The user need only straddle the bench with one leg on either side and slide forward on the bench using the flanking rails to steady or propel the user forward. The bench tapers wider from the narrow approach end towards the far end where it is the size of a standard toilet seat. With a round shaped toilet seat and oval opening at the far end with either a bucket or modification as a traditionally plumbed rear spud ADA compliant toilet, the user can remove his/her necessary garments with ample room to adjust the position of the legs as required for use.

This invention is much more stable than conventional bedside commodes because the weight of the user is on a bench which is bolted to a wide stance plywood base, thus preventing it from tipping over. The high density plastic skids under the front end of the base act as low velocity casters, thus enabling its movement on a wood or composition floor. Furthermore, it is a more versatile device than many bedside commodes as it can be used anywhere in a sickroom, bedroom, hospital room, or in ADA compliant public applications. As it can be manufactured with readily available materials without special knowledge and with average skills, this device is uniquely useful for a broad range of suitable applications.

DETAILED DESCRIPTION OF THE INVENTION

Figure 1:
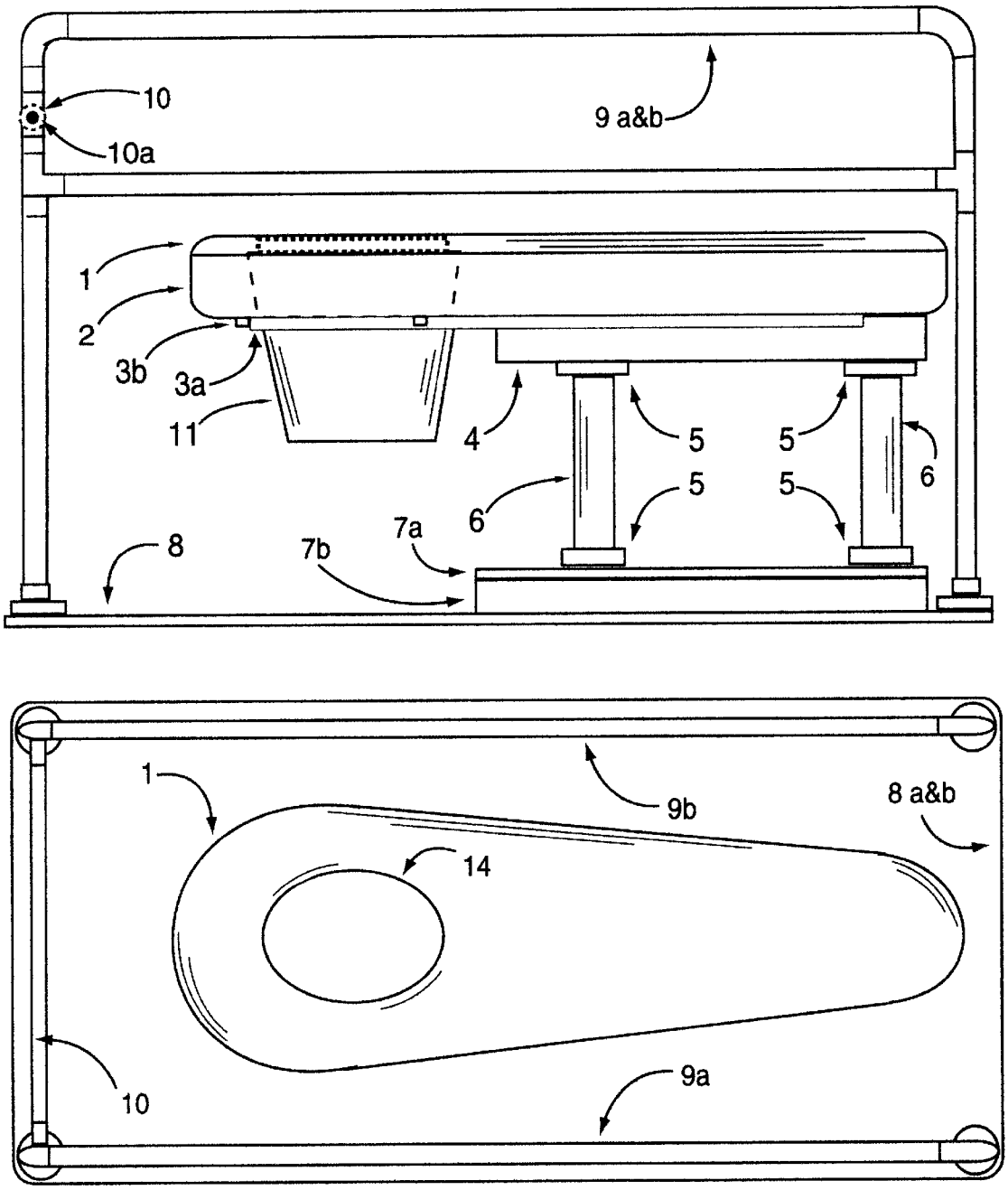
FIG. 1 contains at the top of the page a side elevation of the cantilevered limited mobility toilet and commode with railing and base. At the bottom of the page is a top plan view of the toilet and commode showing the positioning of the commode within the "U" shaped railing.

Referring to the drawing, FIG. 1 presents the general concept of the cantilevered limited mobility bench toilet as presented first in left profile at the top and in a top plan view at the bottom. In both the left elevation at the top and the top plan view at the bottom of FIG. 1 the front or approach to the device is on the right, and the back with the toilet opening is on the left. The left side of the cantilevered bench toilet and commode is the same as the right side, so only the left side will be discussed in detail.

The five (5) elements of the cantilevered toilet are presented in FIG. 1, with each element being fully described in the succeeding figures. The toilet seat is presented as FIG. 2; the lower seat assembly as FIG. 3; the subassembly of the cantilevered support as FIG. 4; the side and back rail structure as FIG. 5; and the base as FIG. 6. A description or view of a standard two and one half-gallon waste collection bucket (item #11, FIG. 1) is omitted because of its ubiquitous nature.

It is in the preferred arrangement of the five (5) elements of this device that it distinguishes itself from all other multifunction limited mobility toilets or commodes. In particular, in using a direct, straight on approach to a cantilevered bench, it is possible to avoid the need to turn through anywhere from 90° to 180° to use the device. Further, because it has a smooth surfaced high density plastic bench with rounded edges and no rough projections to snag or drag, the user need only slide from a bed or wheelchair (with brakes set) directly onto the toilet bench. Persons using a walker need only walk over the narrow approach end and then sit and slide forward, pushing the walker forward to the end rail. Because the height of the subassembly of the cantilevered support can be adjusted to the height of a bed or wheelchair, the user need only slide forward with one leg on each side of the bench. The user can be propelled forward either with hands on the bench or with hands on the parallel side rails. This arrangement eliminates the need to stand, turn, sit, and rise. And, it is this last which, lacking the innovation of this design, has in the prior art endangered those with impaired mobility or stability and required the needed help of an attendant. This invention maintains the safety as well as the dignity of the user.

In FIG. 1, the high density plastic toilet seat 1 rests on a laminated four (4) layered seat subassembly 2. The layered seat assembly 2 is through bolted to the top member 4 of the cantilever support assembly. To stiffen the cantilevered section of the layered seat assembly 2, and limit downward flexure, a steel support ring 3*a* is screwed into the top member 4 of the cantilevered support assembly. The steel support ring 3*a* is also through bolted to three (3) angle irons 3*b*, which are through bolted to the layered seat subassembly 2. The cantilevered support assembly consists of six (6) elements, all bolted together: the top member 4, an upper pair of flanges 5, a pair of steel tubes 6, a lower pair of flanges 5, a lower member steel plate cover 7*a*, and the lower member 7*b*. The plywood base 8 has a chamfered edge on all of the upper edges and is finished with a sanded, no slip paint. The side rails 9*a* & *b* are one and one half inch (1 & ½) tubing, sized to the average hand grip. The end rail 10 is through bolted with threaded rod and nuts 10*a* to hold the assembled side rails together with compressional force.

Figure 2:
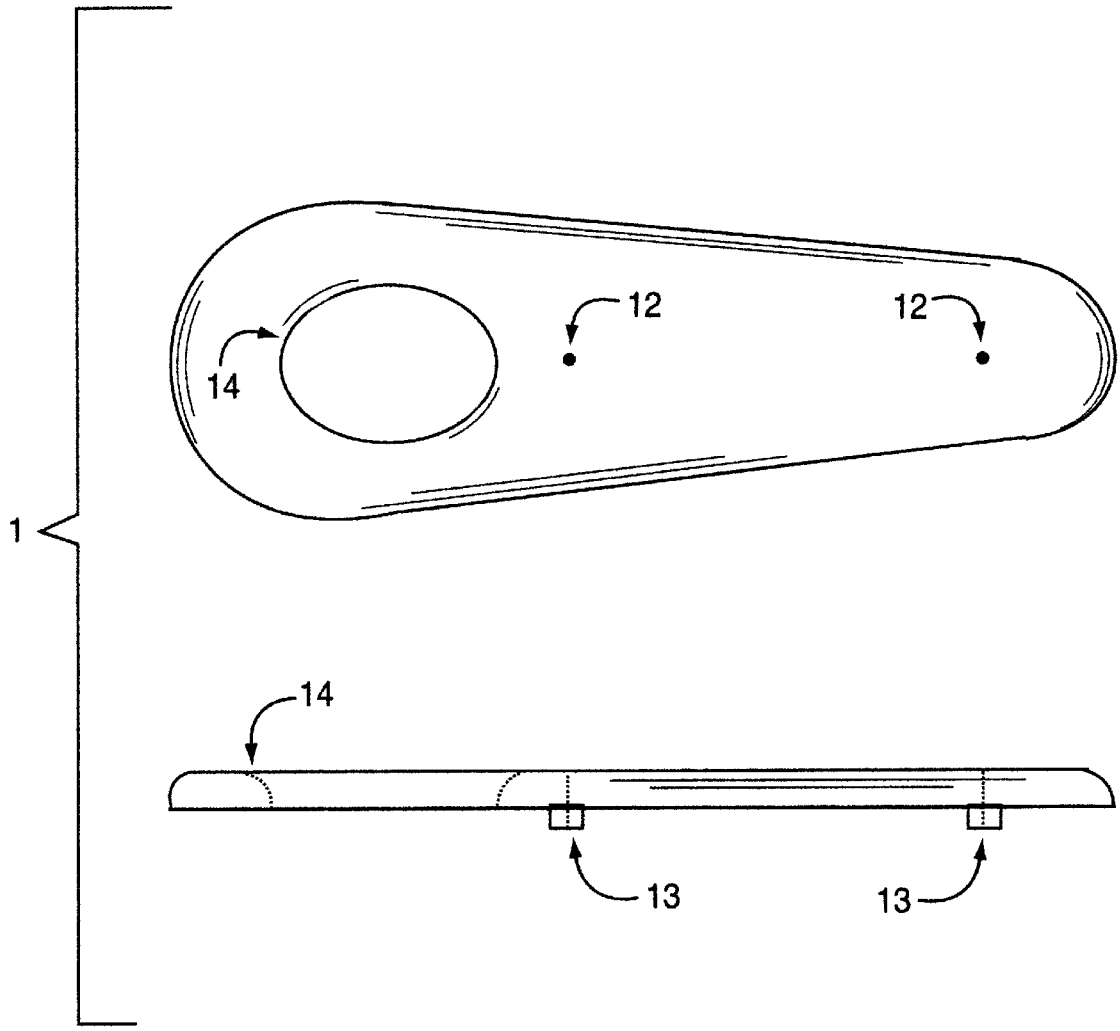
FIG. 2 has at the top of the page a top plan view of the toilet seat with a side elevation view below which presents a pair of round pins that fit into positioning and securing sockets (see FIG. 3) of the lower seat assembly.

In FIG. 2 the toilet seat 1 is shown with its oval opening and with all upper edges chamfered. The lower side elevation view shows the two (2) positioning and securing pins 13 that are through bolted with machine bolts 12 countersunk in the toilet seat 1. The toilet seat 1 is maintained in place and in alignment on top of the lower seat assembly 2 by means of the positioning and securing pins 13. The size and length of these tubular pins along with the weight of the user is sufficient to keep the toilet seat 1 in place during use.

Figure 3:
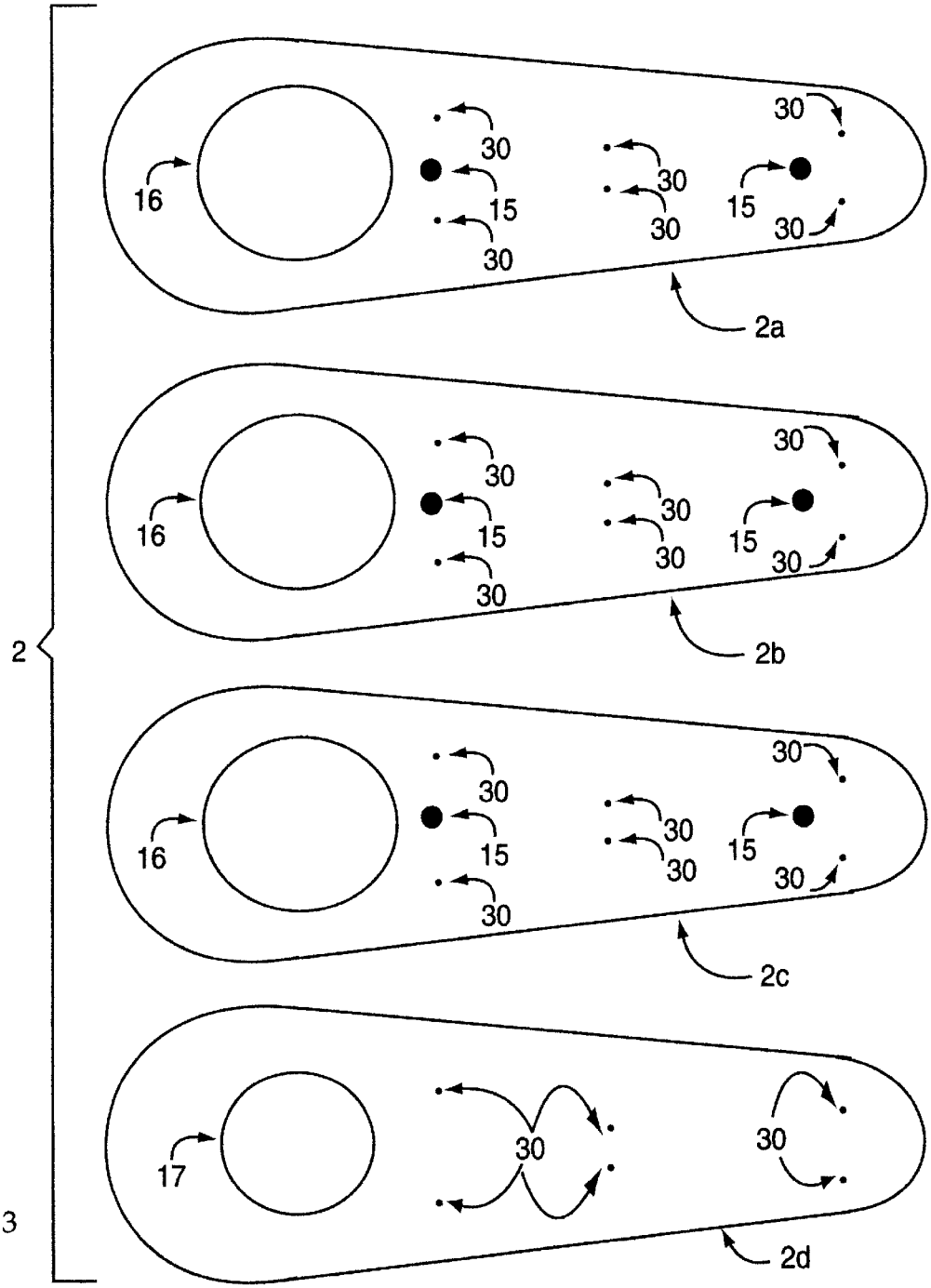
FIG. 3 has arrayed from top to bottom the four (4) successive layers of the lower seat assembly. The top three (3) layers have the sockets to receive the positioning and securing pins of the toilet seat (see FIG. 2), and toilet openings sized to encompass the outer diameter of a bucket with folded handle. The fourth ($4^{th}$) and lowest layer has a toilet opening sized to support the underside lip and folded handle of the bucket.

The lower seat assembly 2 sketched in FIG. 1 is shown in exploded top plan view in FIG. 3, with the uppermost layer at the top through the lowermost view at the bottom. These four (4) layers (2*a*, 2*b*, 2*c* and 2*d*) are through bolted with six (6) bolts 30 to the top member 4 of the cantilevered support assembly. The two (2) securing pins 13 of toilet seat 1 fit into the two (2) sockets 15 that extend through the top three (3) layers (2*a*, 2*b*, and 2*c*) of the four (4) layered seat subassembly 2. The upper round hole 16 for the waste bucket 11 is large enough in the top three (3) layers (2*a*, 2*b*, and 2*c*) of the four (4) layered seat subassembly 2 to accept the upper lip and flattened bucket handle. The lowest layer of the four (4) layered seat subassembly 2 has a smaller diameter hole 17 which acts as a ledge to support the underside lip of the waste bucket 11 and its flattened handle.

Figure 4:
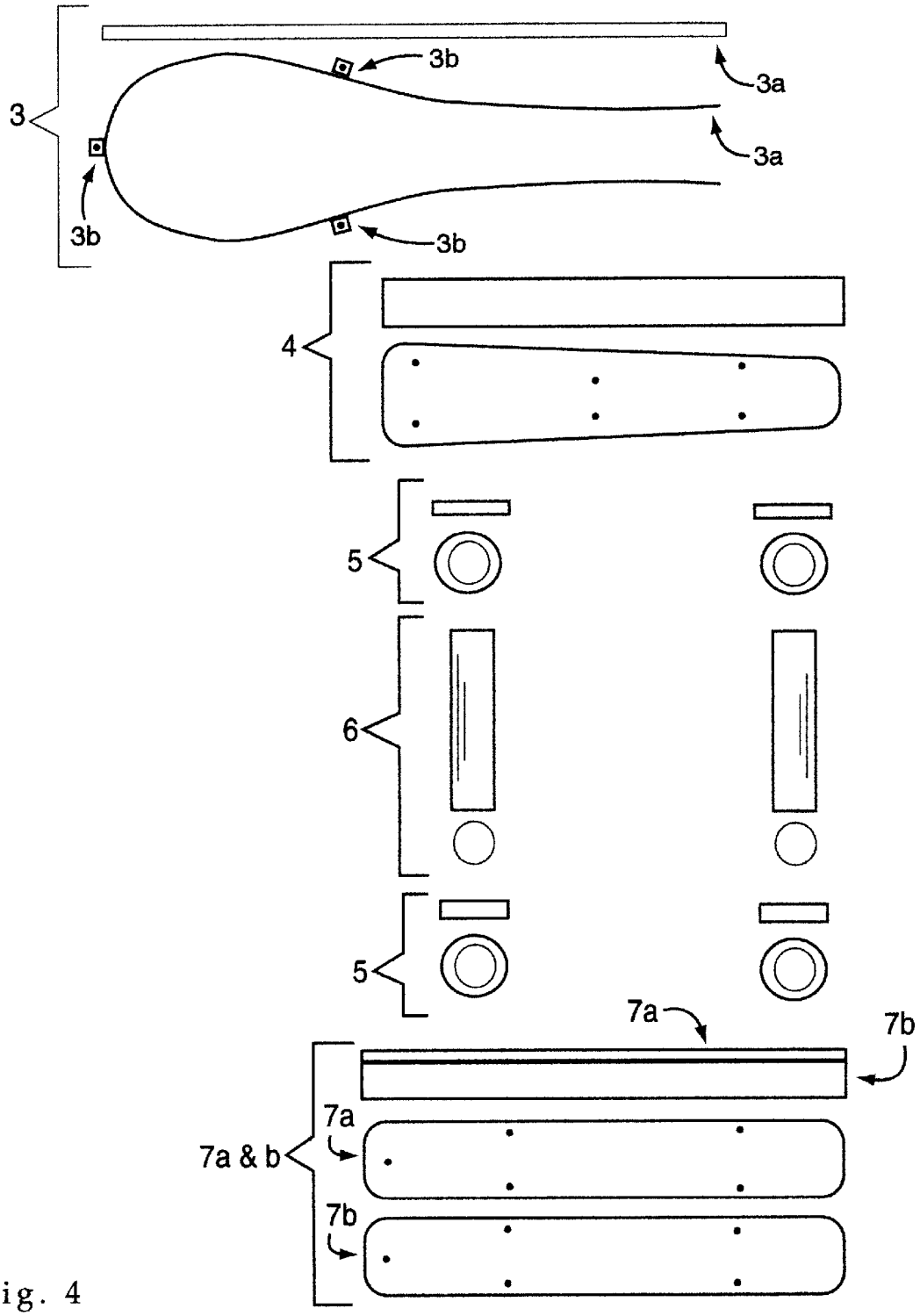
FIG. 4 has arrayed in succession from top to bottom in first side elevation and top plan view the various subassembly elements that make up the cantilevered support for the toilet seat and lower seat assembly.

The six (6) individual elements of the cantilevered support assembly are shown from top to bottom in FIG. 4 in side elevation and top plan view. The steel support ring 3*a* encircles the lower bucket hole 17 on the lower side of the lower layer (2*d*) of the four (4) layered seat subassembly 2, and runs parallel along the outside upper edge of the top member 4. The steel support ring 3*a* with angle irons 3*b* not only stiffens and limits flexure of the four (4) layered seat subassembly 2, it increases the weight load capacity of the cantilevered bench. The top member 4 is not only through bolted with six machine bolts 30 to the four (4) layered seat subassembly 2, it is bolted to the two (2) upper flange 5 with four (4) machine bolts for each flange. The threaded tubing 6 can either be sized for use with the seat height of a wheelchair, a walker, a bed, or can be made adjustable with nested tubing with spring loaded detent variable height pins and slots. The ends of tubing 6 must be screwed into the top and bottom flanges 5. The top and bottom flanges 5 are attached by four (4) machine bolts on the top of each to the top member 4, and on the bottom to the layered lower member steel plate cover 7*a* and the lower member 7*b*. The layered lower member steel plate cover 7*a* and the lower member 7*b* are in turn through bolted by means of five (5) bolts through the wood base 8 and steel backing plates 27 (see FIG. 6).

Figure 5:
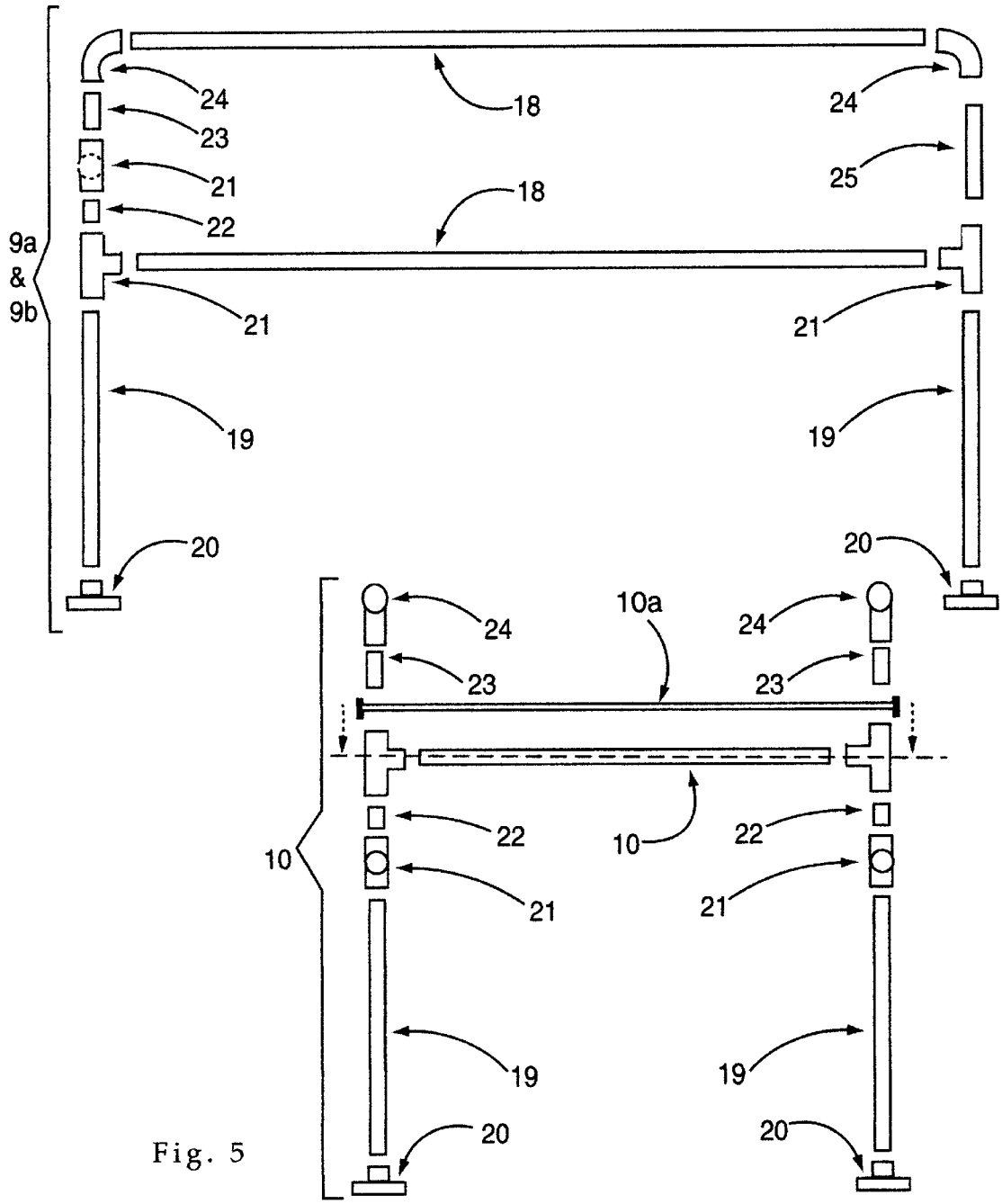
FIG. 5 has from top to bottom a side elevation view of the laddered parallel railings followed by a front elevation view of the back rail with its connection to the side railings.
Figure 6:
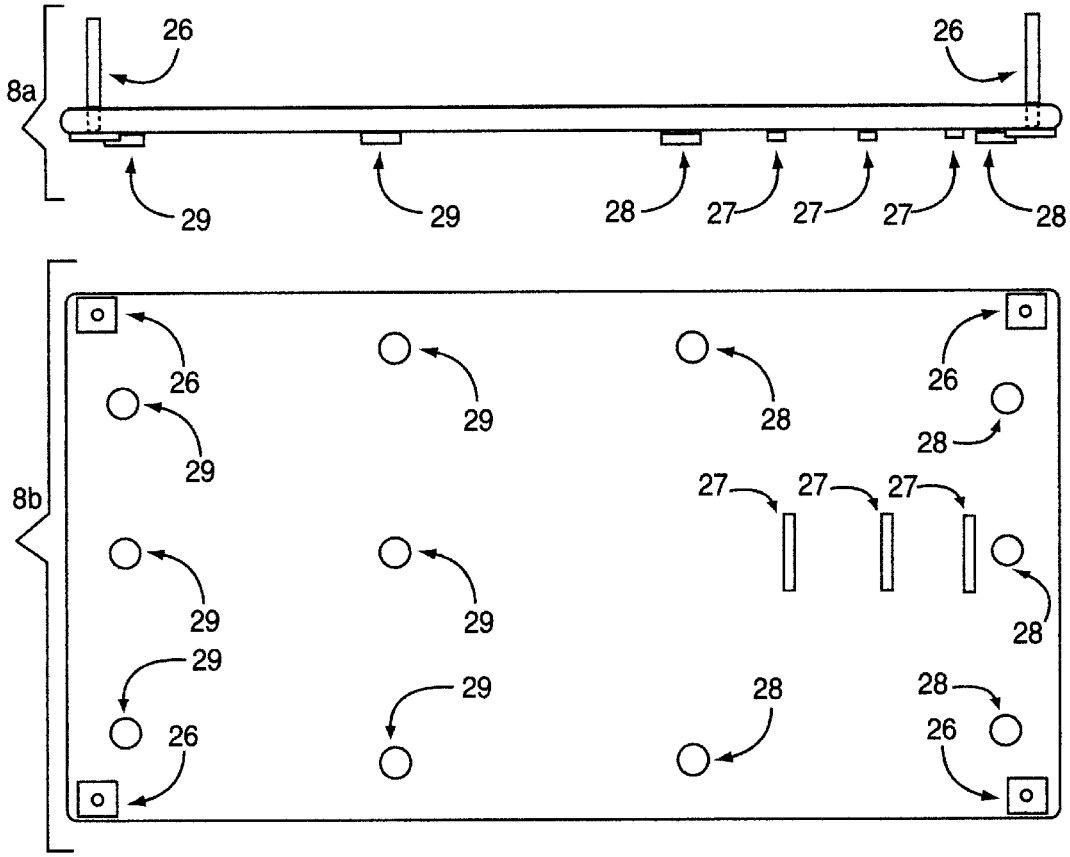
FIG. 6 has from top to bottom a side elevation view of the toilet base and a bottom or from below plan view of the toilet base. The side view shows in profile two (2) of the four (4) pins that extend upwards into the interior of the rail tubing. The bottom plan view of the base shows the positioning of the five (5) high density plastic skids and the six (6) friction skids.

The girding railings on three (3) sides are displayed in left side and back end elevations in FIG. 5. As the device is intended for wheelchair, bedside, and walker applications, the side rails 9*a* & *b* have both a lower and upper rail 18 of equal length. They are, basically, laddered to provide for use in any of the mentioned applications. The construction of the entire device is modular. There are three (3) subassembly groups that can easily come apart for storage or transport: 1) the toilet seat 1, layered seat subassembly 2, and cantilevered support assembly (3*a* & *b*, 4, 5, 6, and 7*a* & *b*), 2) the base 8, and 3) the rails (9*a* & *b* and 10). The rails 9*a* & *b* and 10 are designed as part of this overall pattern of breakdown for storage or transportation. The four (4) leg tubing 19 and floor flange 20 are permanently connected, and each is bolted with four (4) machine bolts through the base. There is an interior nested support 26 (see FIG. 6) which extends into the interior of each of the four (4) leg tubing 19 and floor flange 20. Each side (left and right) of the top rail assembly consists of ten (10) elements (18, 21, 22, 21, 23, 24, 18, 24, 25, and 21) permanently connected together. Each side of the top rail assembly slides onto two (2) of the leg tubing 19 and floor flange 20 subassemblies which are on opposing corners of the base 8. The back rail 10 is a length of tubing that slides into "T" fittings 21 on the back ends of the top rail assembly sides. The top rail assembly sides are kept together by means of a threaded rod with lock nuts 10*a* that passes through back rail 10 and the "T" fittings 21 for back rail 10.

The base 8 is seen in side elevation on top, and from the bottom plan view. The base 8 is composed of four (4) different elements. The four (4) interior nested supports 26 designed to slide inside the leg tubing 19 and floor flange 20 subassembly to offer support and stiffening for the railing and its legs. The three (3) backing plates 27 to provide stabilization for the five (5) bolts that connect the toilet and cantilevered support assembly to the base 8. The five (5) high density plastic skids 28 which act as low velocity casters to allow movement of the entire device in a room. And, the six (6) wood skids 29 to insure that the toilet remains sited unless lifted at the back end to totally engage the five (5) high density plastic skids 28.

That which is claimed is:

1. A mobility assisting device and toilet apparatus comprising:

an adjustable, wedged-shaped, smooth surface, co-planar, ventrally cantilevered bench seat with a toilet opening;

a waste collection bucket positioned below said toilet opening and attached to an end of the bench seat;

said wedged-shaped cantilevered bench seat having a narrow end supported by at least one steel tube and an enlarged end comprising said collection bucket;

said bench seat girded on three sides by three laddered rails, two of said rails positioned parallel to each other;

said bench seat positioned on a base or floor having underside skids supporting the cantilevered wedge-shaped bench;

said bench seat comprises multiple layers, including a low and upper layer, said waste collection bucket is supported by the lowest layer of said seat keeping said bucket in place and its handle aligned by the weight of the seat and said upper layer of the seat having at least two positioning and securing pins kept in place by weight of a user;

wherein a user utilizes the laddered rails for movement, positioning, and stabilizing;

wherein a user can slide directly forward from a wheelchair or the like, onto the said bench using the parallel side rails to aid in forward and backward movement without the need for an attendant or caregiver and with less risk of a fall or injury;

wherein the user can adjust clothing as necessary in a forward sitting attitude at the end of the bench, using an end side rails for positioning and stabilizing.

2. The mobility assisting device according to claim 1 wherein said laddered rails includes at least one leg having reinforcement pins on a T-shaped base that pass through the bottom of said base and bolted from the top of said base through floor flanges at the base of each rail legs.

3. The mobility assisting device according to claim 1 wherein said laddered rails include two parallel side rails and a back rail, wherein said back rail is through bolted with a threaded rod to apply compressional force to maintain the relative positioning as well as stabilize the side rails.

* * * * *